United States Patent [19]

Odham

[11] Patent Number: 4,553,412

[45] Date of Patent: Nov. 19, 1985

[54] FLAT BED KNITTING MACHINE HAVING HIGH SPEED SECONDARY STITCH ATTACHMENT

[75] Inventor: Carl J. Odham, Asheboro, N.C.

[73] Assignee: Stedman Corporation, Asheboro, N.C.

[21] Appl. No.: 577,816

[22] Filed: Feb. 7, 1984

[51] Int. Cl.[4] ..... D04B 23/00

[52] U.S. Cl. ..... 66/207; 66/204

[58] Field of Search ..... 66/207, 204, 203

[56] References Cited

U.S. PATENT DOCUMENTS 4,398,479 8/1983 Czelusniak ..... 66/207

4,417,455 11/1983 Durville ..... 66/207

*Primary Examiner*—Ronald Feldbaum

*Attorney, Agent, or Firm*—Pennie & Edmonds

[57] ABSTRACT

A flat bed knitting machine having a high speed secondary stitch adjustment. A secondary guide bar mounts a secondary guide and is connected by connection means to a main guide bar mounting a plurality of main guides wherein the two guide bars may swing together and wherein they may shog independently of one another.

4 Claims, 10 Drawing Figures

FLAT BED KNITTING MACHINE HAVING HIGH SPEED SECONDARY STITCH ATTACHMENT

FIELD OF THE INVENTION

This invention relates to a flat bed knitting machine having a high speed secondary knitting attachment and more particularly to a connecting means connecting a secondary guide bar mounting a secondary yarn guide to a main guide bar mounting a main yarn guide such that the secondary guide bar and main guide bar swing in unison and at the same time may shog independently of one another.

BACKGROUND OF THE INVENTION

Flat bed knitting machines for warp knitting of fabrics usually have a plurality of knitting needles mounted on a reciprocally movable needle bar which imparts reciprocating movement of the needles along their longitudinal axes. Individual base yarns may be wrapped around the needles by yarn guides in turn mounted on a main guide bar. The main guide bar swings or oscillates forward and backward relative to the needle bar and needles and shogs across the needle paths in reciprocal directions so that the guides move with a lapping motion to wrap each base yarn partially or completely around a needle in order that the needle may form open or closed yarn loops. In single needle bar machines, the guide bar may shog more than one needle width in order that warps formed by the loops may be interconnected to form a warp knit fabric.

One or more secondary guide bars may be provided to guide secondary yarns which may be laid into or knitted into loops formed by the base yarns and/or which may extend in weft directions to connect adjacent wales together formed by the base yarns. In such instances the knitting needles used have been latch-type needles and the secondary guide bars have been such to shog only and not to swing in order that the secondary yarn may be laid across a needle and to engage a latch.

Use of latch-type needles usually results in slower operating knitting speeds since the speed of movement of the needles in a reciprocating direction caused by movement of the needle bar is limited by inertia forces resulting from movement of the latch. Latch-type needles in addition are usually larger than other type needles, as for example beard-type needles, such that spacing between needles is greater. Also latch-type needles are usually more expensive than beard-type needles and more prone to misknit since a latch-type needle will not operate to form further yarn loops in the event a latch is allowed to knock over or close without receiving a yarn as there will then be no yarn available to open the latch during knitting of subsequent courses. Latch-type needles also have a limited operating life as compared to beard-type needles because of wear of the latch pivot.

Beard-type needles normally have not been available for use in flat bed knitting machines since the needles require use of a presser bar to close the needle beards and because flat bed machines lack the space and control mechanisms for moving a presser bar. This has been particularly true when one needle of a flat bed knitting machine is to engage two or more yarns, as for example, a base yarn forming warp extending loops and a secondary yarn extending in a weft direction joining adjacent loops.

Modified beard needles can however be used in flat bed-type knitting machines without use of a presser bar where the modified needle has a slot in the shank of the needle adjacent the tip of the beard and where the slot is inclined with respect to the longitudinal axis of the needle. In these instances yarn is laid across the needle to engage in the slot after which it passes under the beard tip into the hook of the needle. The beard tip is bent towards the slot so that a previously formed loop may slip over the beard as the needle is retracted towards a trick plate.

It is important when using modified beard needles without a presser bar that the swing movement of the base yarn be precise with respect to the needle in order that the yarn will be laid accurately into the slot. This is particularly so when two or more yarns are to be engaged by a single modified beard needle and where one of the yarns is to extend in a weft direction across one or more needles in order to connect adjacent warps made of a base yarn.

It is therefore an object of my invention to provide for a flat bed-type knitting machine which may utilize beard-type knitting needles to allow fast operation of the machine and at the same time provide means by which a secondary guide bar and a main guide bar may be precisely swung in unison and which at the same time will allow individual shogging movment between the two bars in order that a secondary yarn may extend across one or more needle paths and which at the same time may be laid into a slot of a needle.

GENERAL DESCRIPTION OF THE INVENTION

Broadly a flat bed knitting machine according to my invention has a high speed secondary stitch attachment. The machine comprises a plurality of reciprocally movable knitting needles, a plurality of main guides for individually guiding base yarns and a main guide bar mounting the main guides which is adapted for a shogging and swinging motion in order to provide a lapping movement to the main guide to wrap individual yarns around each needle. A secondary guide bar mounting a secondary guide is provided for guiding a secondary yarn. This secondary guide bar is adapted for a shogging and swinging motion such that the secondary guide will guide the secondary yarn into engagement with at least one of the needles to which a base yarn is guided. Connecting means are provided between the main guide bar and the secondary guide bar such that the guide bars will swing together in unison and such that they may shog independently of one another.

The connecting means comprises a first arm connected at one end to the main guide bar and a second arm connected at one end to the secondary guide bar. A slot is included in the end of one of the arms opposite its connected guide bar and a pin is provided on the end of the other arm opposite its connected guide bar such that the pin extends into the slot. In this manner the guide bars are locked together to swing in unison and whereby the pin may slide longitudinally on its axis with respect to the second arm to allow the bars to shog relative to one another. Preferably the slot is in the arm connected to the secondary guide bar while the pin is in the arm connected to the main guide bar.

The pin is adjustably positioned on its arm in order that the degree of swing of one guide bar with respect to the other guide bar may be varied.

DESCRIPTION OF THE PREFERRED EMBODIMENT

Figure 1:
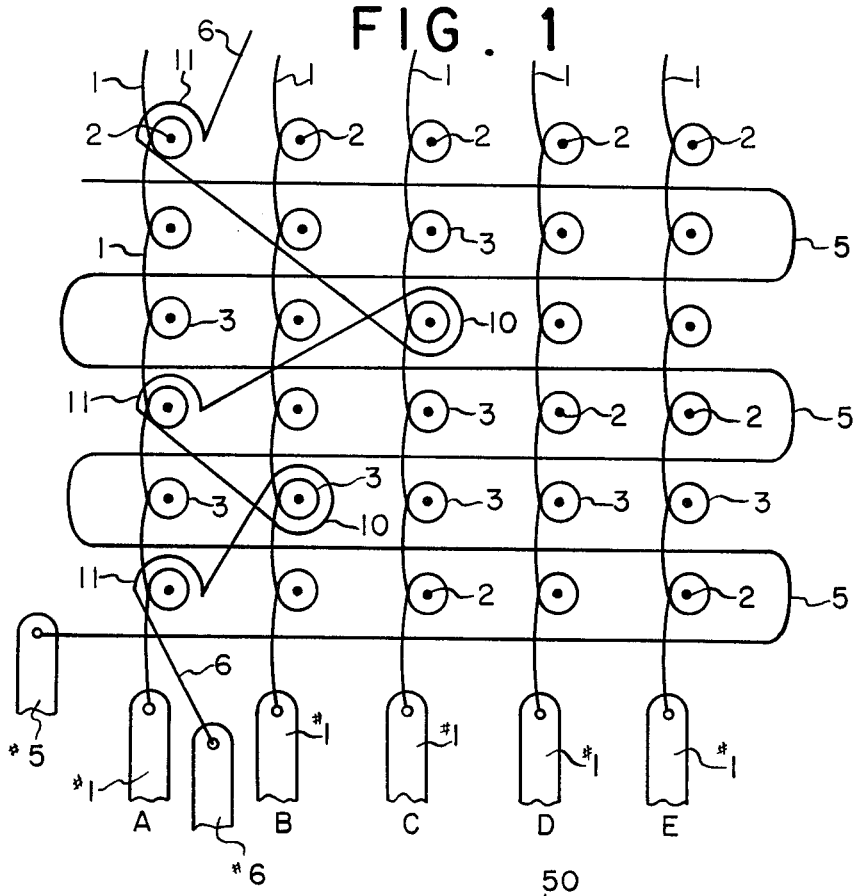
FIG. 1 is a stitch construction diagram of a warp knitted fabric produced by a knitting machine constructed according to the invention.

Referring to FIG. 1 there is illustrated a stitch diagram of a warp knit fabric constructed on a machine according to the invention. The diagram illustrates the movement of various guides and the lapping and laying in of various yarns relative to a bank of five knitting needles. As shown the fabric comprises base yarns 1 which are lapped in the same direction about each of the needles 2 to form a plurality of closed loops 3 which together form warp extending wales A, B, C D and E. Each base yarn 1 is guided by a guide #1 in turn mounted on a guide bar, not shown, which both shogs and swings with respect to the needles in order to lap or wrap a yarn 1 about a needle to form a closed loop 3.

Adjacent warps are connected together in the particular fabric shown by a weft-extending connecting yarn 5 in turn guided by a guide #5 which moves in weft directions across the path of the needles 2. Connecting yarn 5 is not lapped about any of the needles such that the guide #5 controlled in its movement in a guide bar, not shown, to which the guide #5 is connected shogs only and does not swing towards the path of the needles.

A secondary yarn 6 guided by guide #6 connects adjacent wales together, in this instance wales A, B and C and where the yarn 6 is formed into closed loops 10 or open loops 11 in various of the wales. The guide #6 is connected to a guide bar, not shown, which both swings towards and away from the needles and at the same time shogs to the left or right over one or more needles in order to interconnect adjacent wales and at the same time wrap the secondary yarn about a needle. The amount of shog of the guide #6 or whether it is to form a complete loop, an open loop or is to be merely laid into a wale may vary from fabric to fabric and is determined by the characteristics of the fabric to be produced and the machine which is described more fully hereafter is not limited to the production of any particular fabric design.

Figure 3:
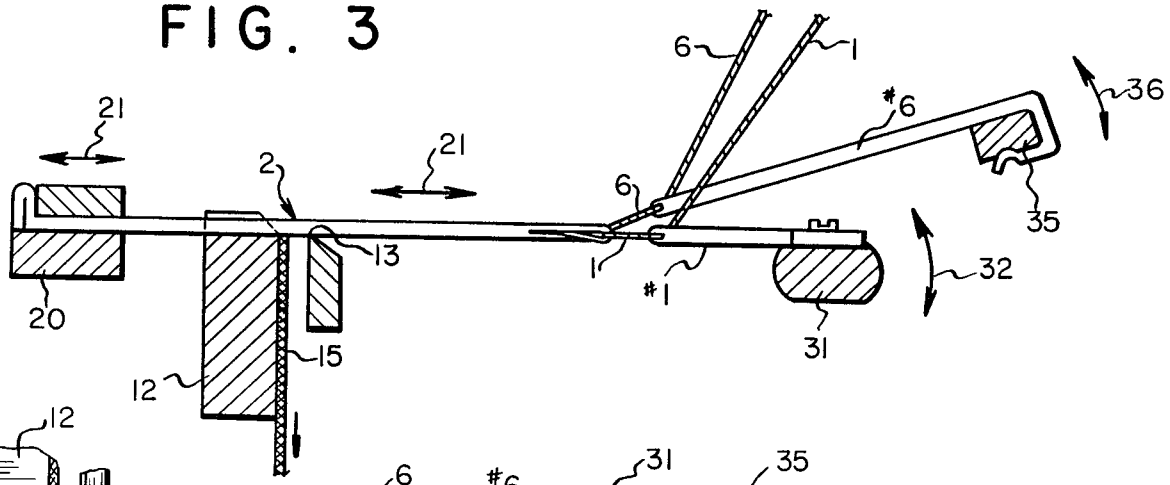
FIG. 3 is a side sectional view of FIG. 2 taken along lines 3—3.
Figure 2:
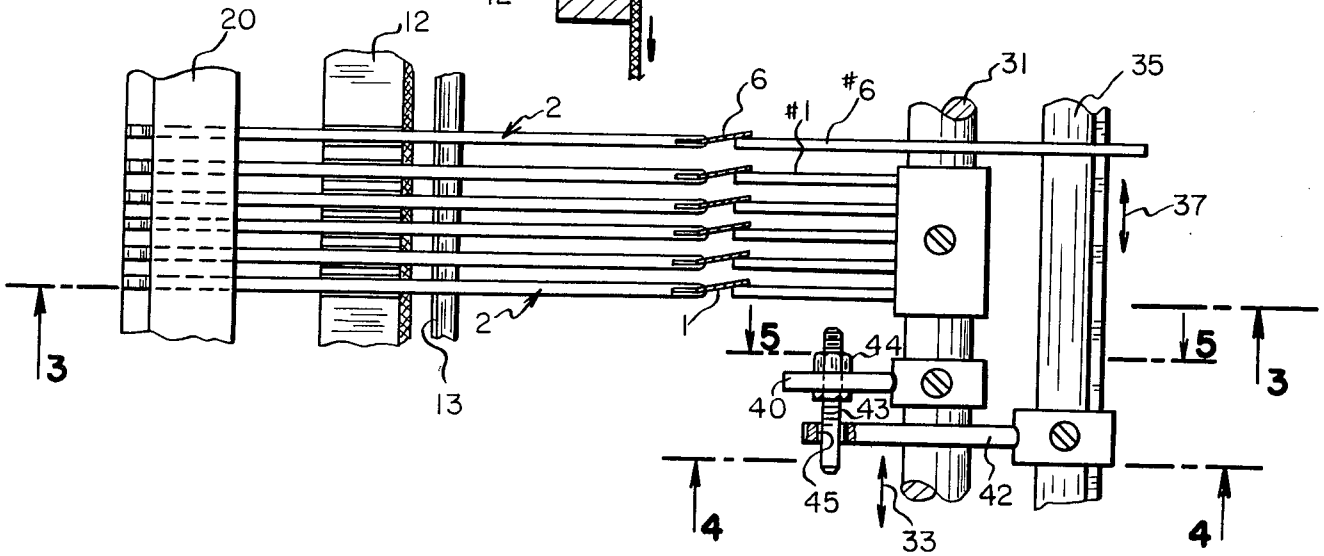
FIG. 2 is a plan view of a portion of a flat bed knitting machine constructed according to the invention illustrating a connecting means between a main guide bar and a secondary guide bar.

Referring to FIGS. 2 and 3 there is illustrated a flat bed-type knitting machine having a plurality of beard needles 2 mounted on a needle bar 20 which reciprocates back and forth in the direction of the arrow 21 to advance and retract the needles with respect to the base yarn guides #1 and secondary yarn guide #6. Base yarn guides #1 are mounted on a main guide bar 31 which swings in the direction of the arrow 32 about the longitudinal axis of the main guide bar in FIG. 3 and reciprocates or shogs in the direction of the arrow 33 in FIG. 2.

The needles 2 slide in a needle guide 12 and in their fully retracted position pull closed loops of the base yarn over the trick plate edge 13 to knock completed loops over the end of the needles 2 where they are cast off such that the fabric 15 formed by the loops may drop downwardly to a fabric gathering station, not shown.

The guide bar #6 which guides the secondary yarn 6 is connected to a secondary guide bar 35 which swings in the direction of the arrow 36 about the longitudinal axis of the secondary guide bar which extends parallel to and is spaced from the longitudinal axis of the main guide bar as shown in FIG. 3 and which reciprocates or shogs in the direction of the arrow 37 as shown in FIG. 2.

Figure 4:
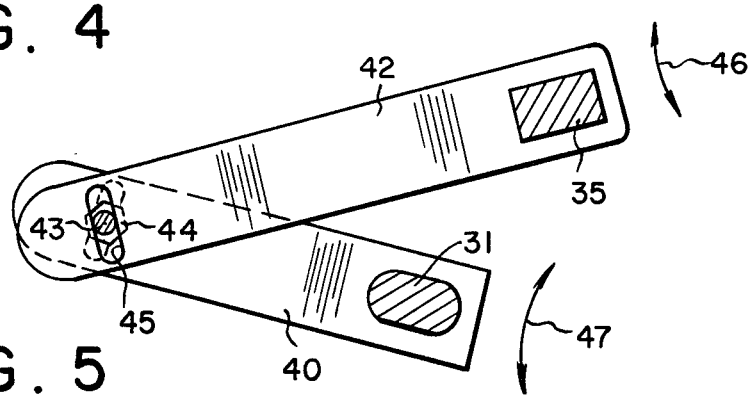
FIG. 4 is an enlarged sectional view of FIG. 2 taken along lines 4—4.
Figure 5:
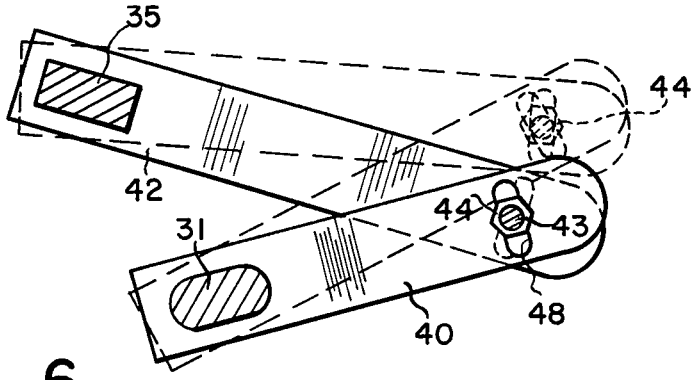
FIG. 5 is a side sectional view of FIG. 2 taken along lines 5—5.
Figure 6:
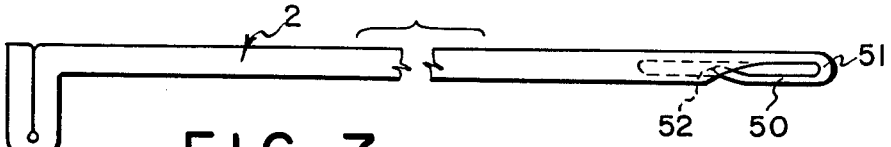
FIG. 6 is an enlarged side view of the knitting needle illustrated in FIG. 3.
Figure 7:
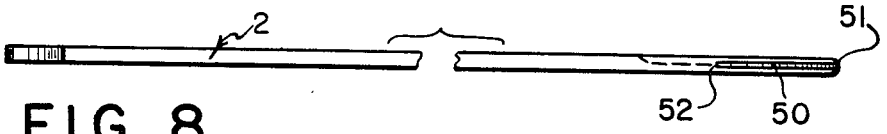
FIG. 7 is a bottom view of the knitting needle of FIG. 6.

A first arm 40 is connected to main guide bar 31 and a second guide bar 42 is connected to the secondary guide bar 35. As shown in FIGS. 2, 4 and 5 the first arm 40 has a pin 43 adjustably connected thereto by a nut 44 with the opposite end of the pin free to slide within a slot 45 contained in an end of the second arm 42. The result is that when the arm 40 swings in the direction of the arrow 47, the arm 42 will likewise simultaneously swing in the direction of the arrow 46, all as shown in FIG. 4.

As best seen in FIG. 5 the arm 40 also has a slot 48 therein within which the pin 43 is adjustably fixed by the nut 44 whereby the degree of swing of the arm 42 may be regulated with respect to that of the arm 40 and so regulate the swing of the guide #6 with respect to that of guides #1. Because the pin 43 is free to slide in slot 45 in the longitudinal direction as well as in circumferential directions, the guide bar 35 may be shogged relative to the guide bar 32 without disturbing the swinging motion between the two guide bars. Thus a secondary yarn may be moved in weft directions across one or more needle widths while at the same time assuring that the lapping movement of the secondary yarn may be in unison with the lapping movement of the base yarn around a needle.

Shogging movement of the secondary guide bar 35 may be accomplished by use of a cam drum similar to conventional cam drums utilized to impart shogging movement to the main guide bar 31.

As explained previously the swinging and shogging movement of the secondary guide bar allows the use of beard needles wherein both the base and secondary yarns may be drawn through a slot contained in the needle.

Figure 9:
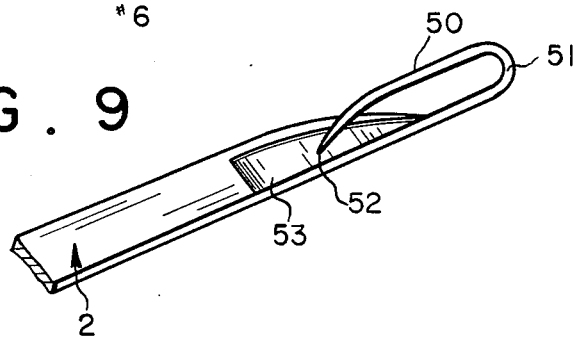
FIG. 9 is a perspective plan view of the end of the knitting needle of FIG. 6; and, FIG. 10 is a perspective view of the bottom of the knitting needle of FIG. 9.
Figure 10:
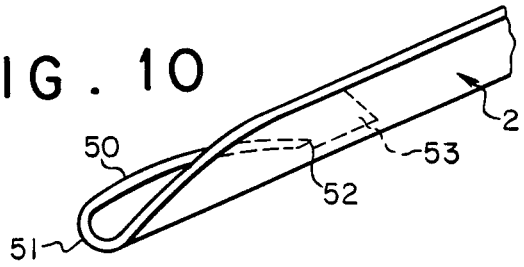
Figure 8:
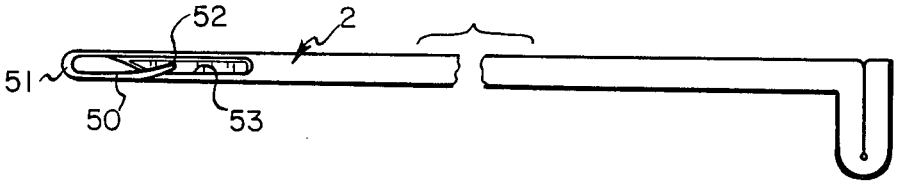
FIG. 8 is an opposite side view of the knitting needle of FIG. 6.

As shown in FIGS. 6–10 a preferred beard-type needle used with a machine according to the invention is a modified beard needle having a beard portion 50 forming a needle head or hook 51 and including a beard tip 52. As shown in FIGS. 8 and 9 the needle contains a slot 53 which extends at approximately 45 degrees with respect to the longitudinal axis of the needle. The result is that when yarns are laid into the slot 53, they may pass under the tip 52 to be engaged by the needle head or hook 51. When the needle is retracted with respect to the trick plate, loops formed on the needle may slide or pass over the beard tip 52 so as to be cast off from the needle. Thus the needle does not need the use of any presser plate and its accompanying mechanism to force the needle beard to a closed position.

The swinging motion of both the main and secondary guide bars combined with the shogging motion of the bars allows the yarns to be inclined with respect to the movement of the needles so as to extend into the slot 53 of the needles. Use of a conventional flat bed knitting machine wherein secondary guide bars move only in weft directions without swinging would cause the secondary yarn to extend at generally right angles across the needle so that it would not extend into the slot 53 and thus would not be able to pass beneath the beard tip 52. Such a construction only allows use of a latch-type needle in order to assure that the secondary yarn may engage within the needle hook. Thus my invention of having the secondary guide bar which swings in unison with a main guide bar and which shogs independently of the main guide bar assures that a secondary yarn may extend across a needle in substantially the same plane as a base yarn and so as to allow use of a beard-type needle.

I claim:

1. A flat bed knitting machine having a high speed secondary stitch attachment, said machine comprising a plurality of reciprocally movable knitting needles, a plurality of main guides for individually guiding each of a plurality of base yarns, a main guide bar mounting said main guides adapted for a shogging and swinging motion about its longitudinal axis to impart a lapping movement to said main guides to wrap individual base yarns about an individual needle, a secondary guide for guiding a secondary yarn, a secondary guide bar mounting said secondary guide adapted for shogging and swinging motion about its longitudinal axis which extends parallel to and is spaced from the longitudinal axis of the main guide bar for guiding said secondary yarn into engagement with at least one of said needles to which a base yarn is guided, and connecting means between said main guide bar and said secondary guide bar for connecting said guide bars together for unified swinging movement and for shogging movement independent of one another.

2. A flat bed knitting machine having a high speed secondary stitch attachment, said machine comprising a plurality of reciprocally movable knitting needles, a plurality of main guides for individually guiding each of a plurality of base yarns, a main guide bar mounting said main guide adapted for a shogging and swinging motion to impart a lapping movement to said main guides to wrap individual base yarns about an individual needle, a secondary guide for guiding a secondary yarn, a secondary guide bar mounting said secondary guide adapted for shogging and swinging motion for guiding said secondary yarn into engagement with at least one of said needles to which a base yarn is guided, and connecting means between said main guide bar and said secondary guide bar for connecting said guide bars together for unified swinging movement and for shogging movement independent of one another, said connecting means comprising a first arm connected at one end to said main guide bar, a second arm connected at one end to said secondary guide bar, a slot in the end of one of the arms opposite its connected guide bar and a pin on the end of the other arm opposite its connected guide bar extending into said slot whereby said guide bars are locked together to swing in unison and whereby said pin may slide longitudinally of its axis to allow said bars to shog relative to each other.

3. A flat bed knitting machine according to claim 2 wherein said slot is in said second arm and said pin is in the end of said first arm.

4. A flat bed knitting machine according to claim 3 wherein said pin is adjustably positioned on its arm.

* * * * *